United States Patent [19]

Sitton

[11] Patent Number: 4,856,680

[45] Date of Patent: Aug. 15, 1989

[54] METHOD AND APPARATUS FOR DISPENSING BEVERAGES

[76] Inventor: Robert E. Sitton, 4829 Bay Court Ave., Tampa, Fla. 33611

[21] Appl. No.: 196,815

[22] Filed: May 17, 1988

Related U.S. Application Data

[63] Continuation of Ser. No. 785,645, Oct. 9, 1985, abandoned.

[51] Int. Cl.[4] ..... B67D 1/08; B65D 83/14

[52] U.S. Cl. ..... 222/152; 222/396; 222/397; 222/130; 222/190

[58] Field of Search ..... 222/152, 396, 397, 399, 222/330, 129.1, 130, 131, 190; 99/323.1; 426/312, 316

[56] References Cited

U.S. PATENT DOCUMENTS

| | | | |
|---|---|---|---|
| 578,142 | 3/1897 | Fierz | 222/330 X |
| 2,040,661 | 5/1936 | Liebmann | 426/312 X |
| 2,120,297 | 6/1938 | Reinecke | 222/397 X |
| 2,181,838 | 11/1939 | Tressler | 426/312 X |
| 2,593,770 | 4/1952 | Kollsman | 261/64.3 |
| 2,637,652 | 5/1953 | Ryan | 426/312 X |
| 2,756,105 | 7/1956 | Magill | 222/131 |
| 3,430,817 | 3/1969 | Falkenberg | 222/173 |
| 3,472,425 | 10/1969 | Booth et al. | 222/397 X |
| 3,638,831 | 2/1972 | Pauwels et al. | 222/399 X |
| 3,676,010 | 7/1972 | Kirch | 222/394 UX |
| 3,883,043 | 5/1975 | Lane | 222/399 X |
| 3,900,571 | 8/1975 | Johnson | 426/15 |
| 3,927,700 | 12/1975 | Trinne et al. | 141/5 |
| 4,259,360 | 3/1981 | Venetucci | 426/231 |
| 4,347,695 | 9/1982 | Zobel et al. | 53/432 |
| 4,392,578 | 7/1983 | Fipp et al. | 222/152 X |
| 4,401,016 | 8/1983 | Adams et al. | 222/397 X |
| 4,473,174 | 9/1984 | Heuser | 222/152 |
| 4,475,576 | 10/1984 | Simon | 215/311 X |
| 4,597,422 | 7/1986 | Kovacevich, Jr. | 141/85 |
| 4,624,391 | 11/1986 | Shannon | 222/53 |
| 4,691,842 | 9/1987 | Foures | 222/39.7 X |
| 4,693,054 | 9/1987 | Spargo | 53/432 |

FOREIGN PATENT DOCUMENTS

| | | | |
|---|---|---|---|
| 250034 | 9/1959 | Australia | 426/316 |
| 2364375 | 10/1975 | Fed. Rep. of Germany . | |
| 2507587 | 12/1982 | France . | |
| 224335 | 12/1983 | German Democratic Rep. . | |
| 52-65316 | 5/1977 | Japan . | |
| 577232 | 7/1976 | U.S.S.R. | 426/592 |
| 678064 | 2/1978 | U.S.S.R. . | |
| 2089191 | 6/1982 | United Kingdom . | |
| 2134496 | 8/1984 | United Kingdom . | |

OTHER PUBLICATIONS

Advertisement "The Keeper" by Winekeepen, Santa Barbara CA.

Article "Wine Bar Experiments With Wine Dispensing Machine" *Market Watch,* Sep. 1981, 1 p.

New York, "Best Bets", 1 p.

Wine World, vol. 10 No. 4 May-Jun. 1981, 1 p., "Field Reports".

*Primary Examiner*—Joseph J. Rolla
*Assistant Examiner*—Mona C. Beegle
*Attorney, Agent, or Firm*—Dowell & Dowell

[57] ABSTRACT

A method and apparatus for preserving and dispensing opened containers of beverages and particularly wines wherein an opened bottled or similar container is placed within a separate enclosure and thereafter an inert gas such as nitrogen is introduced therein until pressures exceeding those desired for dispensing are achieved so as to purge any air from the enclosure and container with the gas pressure being applied equally inside and outside of the bottle or container to thereby preserve the contents of the bottle or container at a peak and consumer acceptable quality. The apparatus includes an enclosure having gas inlet and outlet valves and fluid dispensing conduits which communicate the beverage with dispensing valves.

2 Claims, 4 Drawing Sheets

27
23
24
28
30
2
25
22
26
4
13
10
32
37
36
20
3
31
29
16
18
35
34
14
12
W
39
38
19
17
21
15
34'

201
199
196
198
200
O2
N2
197
195
194
188
186
190
187
164
170
171
167
168
191
192
185
193
172
180
182
178
184
175
179
163
176
183
177
161
160
12
W
173
166
174
162
165

METHOD AND APPARATUS FOR DISPENSING BEVERAGES

This application is a continuation of application Ser. No. 06/785,645, filed 10/09/85, now abandoned.

BACKGROUND OF THE INVENTION

1. Field of the Invention

This invention is generally directed to methods and apparatuses for dispensing beverages and particularly to methods and apparatuses for improving the shelf life of opened bottles or other containers of wines and other beverages. The apparatuses include enclosures in which opened bottles or other opened containers of beverages are housed so that the contents thereof may be subjected to an environment of high pressure inert gas such as nitrogen while the interior of the enclosures are simultaneously being vented to atmosphere. Thereafter, the pressure may be selectively reduced for subsequent product dispensing at initial dispensing pressures of up to approximately 15 p.s.i.g. The methods are believed to not only remove air within the enclosures but also purge excess oxygen from solution in the beverages thereby preventing further oxidation thereof. In this manner, the shelf lives of wines and other beverages may be preserved for periods exceeding four to six weeks. The apparatuses insure that the pressures within the bottles or other containers of wines or other beverages are offset by similar pressures within the enclosures surrounding the containers so that increased pressures can be applied to the contents thereof without risk of damaging or destroying the beverage containers. In one embodiment, a beverage such as wine may be selectively aged and then preserved at its peak utilizing an apparatus of the invention.

2. History of the Prior Art

In recent years there has been a growing interest in the desire to provide alternative means for dispensing beverages and particularly wines in order to facilitate consumer service and decrease product waste. A major direction of these efforts has been to increase the shelf life of various opened containers of beverages. Prolonging shelf life is particularly advantageous for the dispensing of products which are normally stored in containers wherein the volume of product is greater than the amount of product which is likely to be utilized or consumed at one time. Also, a prolonged shelf life is particularly beneficial if it is possible to preserve the original quality and palatability of the product. In the past, it has not been possible to adequately prolong the shelf life of opened bottles or other opened containers of such beverages as wines and the like.

In some instances, a single bottle of wine may be so rare as to demand hundreds or even thousands of dollars on the consumer market. In such cases, once the bottle of wine has been opened, the value of the wine is destroyed. Once the wine is exposed to a new source of oxygen, the aging process or further oxidation of the wine is accelerated thereby destroying the possibility of the further resale or later consumption of the wine. In such circumstances, if the shelf life of the product could be extended, the contents of an expensive bottle of wine could be preserved over a period of time either for the enjoyment of the original purchaser or for subsequent consumption and/or distribution to other consumers.

Currently, innkeepers and winekeepers and the like have begun utilizing refrigeration and inert gas storage techniques for increasing the shelf life of opened bottles of wine. The use of refrigeration not only reduces the rate of oxidation of a wine after it has been opened to atmosphere, but also provides for a chilled product which is preferred by many consumers. Use of inert gases has also been made to reduce or retard the rate of oxidation in wines by decreasing the amount of oxygen required to promote oxidation of the alcohol within the wine.

In utilizing inert gases to preserve the life of opened containers of beverages, the containers are initially opened and exposed to atmosphere and thereafter, a plug is inserted to seal the contents. Inert gas such as nitrogen is subsequently introduced into the container and serves to provide pressure for dispensing the fluid therein and at the same time provides a nitrogen-enriched environment above the fluid. Unfortunately, as most wines and other beverages are stored in glass containers, the amount of pressure which can be applied within the container is very limited. Because of this, operating pressures of up to 5 p.s.i.g. are generally not exceeded, not possible or not practical for use in present wine preserving and dispensing systems. In addition, the plugs or valves which are used to seal containers prior to pressurization often leak, come loose or pop free from engagement with the containers thereby releasing the inert gas and admitting various amounts of air so that further aging is allowed to proceed. As the wine is exposed to more oxygen, oxidation will continue until the wine spoils. Generally, it has not been possible to preserve the shelf life of wines more than several weeks without the wine beginning to spoil.

SUMMARY OF THE INVENTION

This invention is directed to methods and apparatuses for preserving and dispensing beverages and particularly wines from bottles or other normally sealed containers wherein an opened container of beverage is placed within a sealed enclosure and thereafter subjected to an environment of high pressure inert gas at pressures in excess of approximately 20 p.s.i.g. (gauge) and wherein the pressure within the container is simultaneously balanced with the pressure within the enclosure so that failure of the container due to increased pressure is prevented. As the inert gas is being introduced, the container is vented to atmosphere thereby permitting air and oxygen to be purged therefrom. The pressure of inert gas may thereafter be selectively reduced to a lower initial dispensing pressure in the range of approximately 15 p.s.i.g. or less and the beverage stored at the lower pressure for future dispensing. The enclosure is of a size to receive the beverage container completely therein and includes a cover to seal the enclosed container from the surrounding environment. Valves are provided to permit the inlet of gases including inert nitrogen into both the enclosure and beverage container and to permit the exhaustion or purging of gases therefrom once a predetermined pressure is achieved. Conduits are also provided to dispense the beverage contents of the container either directly from the enclosure or through secondary dispensing units such as conventional refrigerated dispensers. In some embodiments, oxygen may be selectively supplied to the enclosures to promote the aging of wines which have not yet reached their peak.

It is a primary object of this invention to provide a method for preserving and dispensing beverages and especially wines and other alcoholic beverages wherein an opened container of the beverage is maintained in a peak and consumer acceptable quality over periods in excess of four to six weeks after having been opened.

It is also an object of the present invention to provide a method of preserving the alcoholic content and flavor of opened containers of beverages including wines wherein the wines are subjected to environments of high pressure inert gas at the same time any oxygen or air is purged therefrom so that further aging of the beverage is prevented thereby insuring the palatability and peak of flavor of the wines for long periods of time after such containers have been opened.

It is a further object of the present invention to provide a method of preserving and dispensing beverages in which an opened container of a beverage is housed within a supplemental enclosure and therein subjected to pressures of inert gases which would normally rupture or destroy the beverage container and which act to preserve the overall shelf life of the beverage by enabling oxygen to be removed from the beverage environment.

It is another object of the present invention to provide a method for preserving and dispensing such beverages as wines and the like wherein the beverages may be dispensed portion by portion over extended periods of time without adversely affecting the consumer quality thereof.

Another object of the present invention is to provide a dispensing system for beverages such as wines and the like wherein high pressure inert gas is used to initially vent or expel oxygen from the dispensing enclosure so that subsequent oxidation or aging of the wine is prevented even when dispensing pressures created by the inert gases with the dispensing enclosure drop to zero or atmospheric pressure.

A further object of the present invention is to provide an enclosure for housing opened bottles of wine for future dispensing wherein the contents thereof may be systematically aged by the selective introduction of an oxygen gas into either the wine bottle or container to thereby promote the aging of the wine and wherein further aging can be halted by exposing the wine to high pressure inert gas while purging air and oxygen within the environment surrounding the wine to thereby prevent further oxidation thereof.

DESCRIPTION OF THE PREFERRED EMBODIMENT

Figures 1, 2:
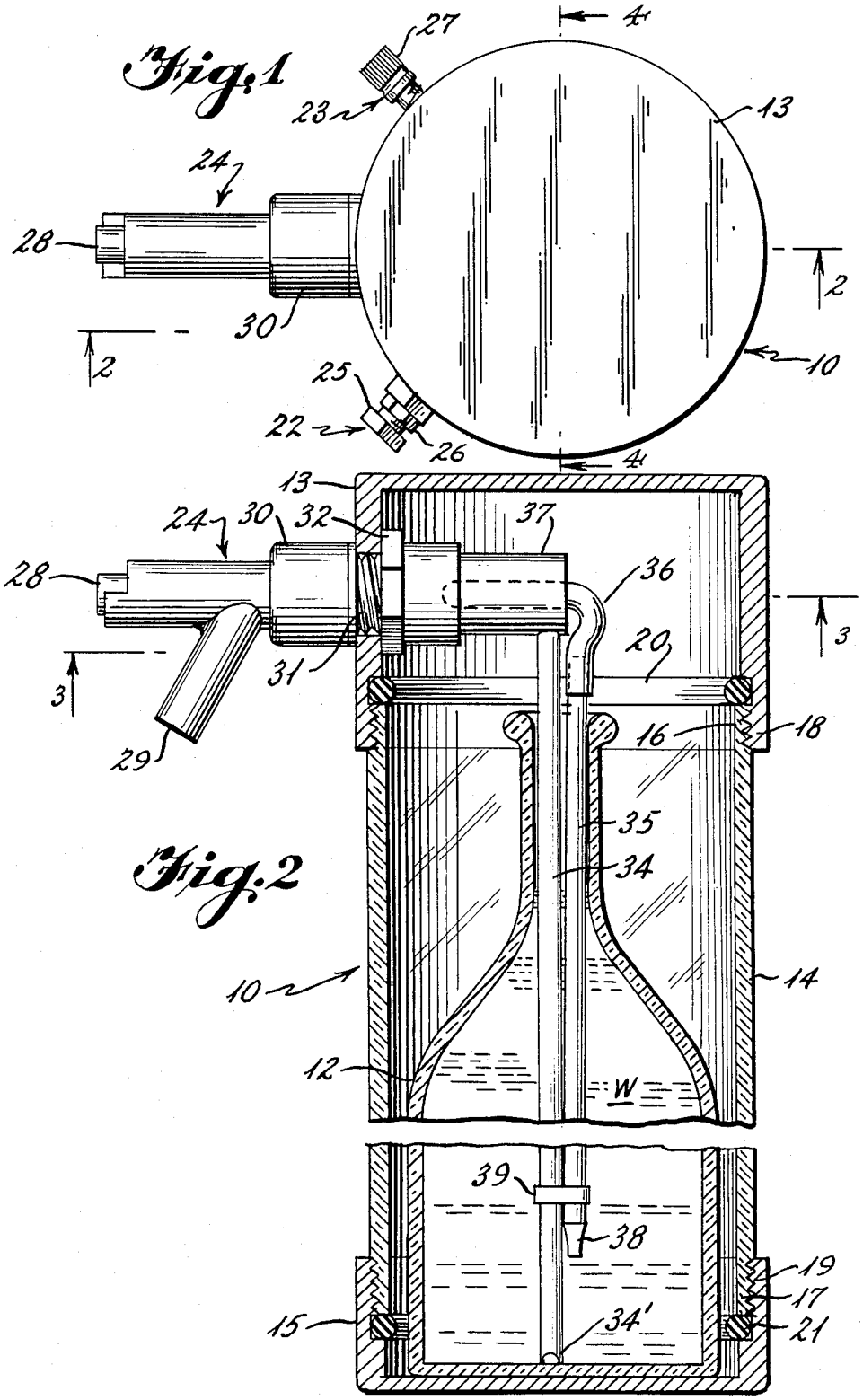
FIG. 1 is a top plan view of a preferred form of enclosure apparatus of the present invention.
FIG. 2 is a cross sectional view taken along lines 2—2 of FIG. 1 having portions broken away.

With continued reference to the drawings, the containers or enclosures of the present invention are shown as being specifically used to house opened bottles of wine or similar beverage so that the contents thereof may be retained at their peak, palatable and consumer acceptable condition. It is well known that exposure of beverages to air, such as when a bottled wine has been opened, results in the contents rapidly oxidizing until a point where spoilage occurs. The dispensing enclosures of the present invention have been designed to extend the life of opened bottles or containers of wine and other beverages and food products for unlimited periods utilizing the methods as will be hereinafter described in greater detail.

The primary consideration in extending the useful or shelf lives of comestible consumer products including wines and other alcoholic beverages is to provide a low cost method of preventing the continued oxidizing process which leads to spoilage and unpalatability of such products. Current processes which utilize inert gas pressurization of comestible products including wines apply gases at pressures of up to about 5 p.s.i.g. within the product containers. The design of the product containers makes the addition of greater pressures unsafe.

Through testing of various comestible products and primarily wines, it has been determined that the useful life of opened containers of such products may be extended well beyond the limits achievable using current gas pressurization techniques. A basis of the present methods appears to be the ability to subject wines and other similar comestible products to high pressures of inert gas so as to substantially purge all oxygen from such products and thereafter storing the products in inert gas environments.

Particularly, through testing which is still continuing with regard to the methods of the invention, opened bottles of wines have been placed within enclosures wherein pressures of approximately 20 to 30 p.s.i.g. are originally applied thereto. The interiors of the enclosures which house the wine bottles are also placed under the same pressure so that the pressures interiorly and exteriorly of the bottled wines are balanced thereby preventing the possibility of the bottles failing or exploding under pressure. As the wines are being pressurized to approximately 20 p.s.i.g. and preferrably between 20 to 30 p.s.i.g., the air or oxygen within the bottles and enclosures is vented to atmosphere. The pressure level may thereafter be permitted to drop or is decreased to lower dispensing pressures, which may be in the range of approximately 5 to 15 p.s.i.g. dependent upon an enclosure's volume or capacity. Although the products may be stored and dispensed at higher pressures, it is preferred to store the products at the lower dispensing pressures so that the products may be dispensed directly from the enclosures without requiring removal of the product containers therefrom. Preferrably, the storage pressures are retained at approximately 10 p.s.i.g. until a product is initially dispensed and thereafter the pressure will decrease as the product level drops.

It is theorized that the initial high pressure treatment of the contents of opened containers or bottles of wine actually functions to drive even the slightest remaining oxygen from solution, thereby preventing further oxidation of the wine. Thereafter, the wine can be maintained in an inert atmosphere over long periods of time at lower pressures with further aging or oxidation eliminated.

By way of example, a Royal OPORTO, 1970 vintage Portuguese Port was open and exposed to atmosphere and tasted on June 19, 1985. After tasting, the opened bottle was placed into an enclosure of the type generally shown in FIG. 4 of the drawings. The enclosure surrounding the bottle was sealed and thereafter inert nitrogen gas was introduced therein. As the pressure reached approximately 15 p.s.i.g., a valve on the enclosure opened permitting the air therein to be vented to atmosphere. The pressure was continuously raised to approximately 25 p.s.i.g. and then permitted to slowly decrease. The pressure was finally lowered to approximately 10 p.s.i.g. and the product placed in storage. The product has been periodically tasted by dispensing a portion thereof utilizing a pressure reducing dispensing valve mounted to the container. To the date of the preparation of the application or Oct. 7, 1985, the wine remains at its peak flavor and totally palatable and fit for consumer consumption. No noticable deterioration in the product has taken place.

Figure 4:
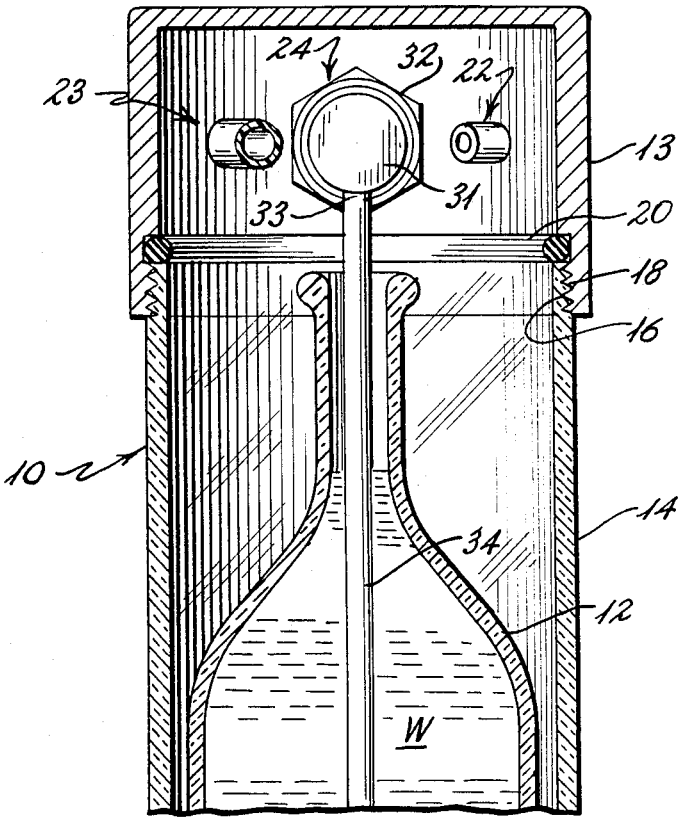
FIG. 4 is a cross sectional view taken along lines 4—4 of FIG. 1 showing a modified embodiment of the invention of FIG. 1. wherein the oxygen tube is not utilized.

A second test was made on an opened bottle of a Gammay Beaujolois, vintage 1980, wherein the opened container or bottle was also placed in a dispenser enclosure similar to that shown in FIG. 4 of the drawings. A nitrogen gas was used to drive off the air and raise the pressure within the enclosure and bottle to between 20 to 25 p.s.i.g. Again, the enclosure was vented to atmosphere where the pressure reached approximately 15 p.s.i.g. Thereafter, the pressure was reduced to an initial dispensing pressure of approximately 8 to 10 p.s.i.g. On July 30th, the wine bottle was removed from the enclosure and the wine tasted. The wine was found to have remained at its peak flavor and taste and, again, the wine appeared to be as good and as consumable as it was when originally opened.

The enclosure used in the second example was then used on July 30, 1985 to house a bottle of La Tache 1957, bottle No. 15198 which had been opened and had begun to turn cloudy. Inert nitrogen was added and the gas pressure was raised as discussed with respect to the previous examples to approximately 25 p.s.i.g. while the oxygen was vented and then the pressure reduced to approximately 10 p.s.i. To the time of the execution of this application or Oct. 7, 1985, the wine had not deteriorated or spoiled further than it had on July 20th.

A fourth test was made using an opened bottle of Kistler Sauvinoin-Blanc 1982. The wine was placed within an enclosure similar to those of the preceding examples and thereafter the inert nitrogen added to pressurize the wine to 20 to 25 p.s.i.g. while the air and oxygen was vented from the enclosure. The pressure was then reduced to 10 p.s.i.g. The wine was originally treated on June 18, 1985 and was dispensed for consumer taste testing on July 31, 1985. The wine remained of excellent consumer quality and taste.

Although the foregoing tests have been made with initial pressures between 20 to 30 p.s.i.g., it is believed that greater pressures could also be used and that under certain circumstances slightly lesser initial pressures could be used as for example 18 to 20 p.s.i.g. Also, although the examples reflect initial storage pressures in the range of 8 to 10 p.s.i.g., it is believed that pressures ranging from 0 to 15 p.s.i.g. could be suitable under some conditions. In this regard, it should be noted that the initial storage pressure is also the initial dispensing pressure. Also, such pressures could be as high as the highest pressure achieved during the introduction of the inert gas. The pressure is preferrably lowered for storage and dispensing as pressures in excess of 15 p.s.i.g. are generally not necessary. As the inert gas within an enclosure will be used to dispense the wine product from an opened bottle housed therein, the initial dispensing pressure need only be high enough to insure that the entire contents of the bottle can be dispensed. Although the pressure will continue to decrease as the wine is dispensed, the wine remaining will be preserved in the inert gas environment even though the pressure may drop to zero p.s.i.g. (i.e. atmospheric pressure) as substantially all oxygen was originally purged from the environment thereby preventing further oxidation of the wine.

Figure 3:
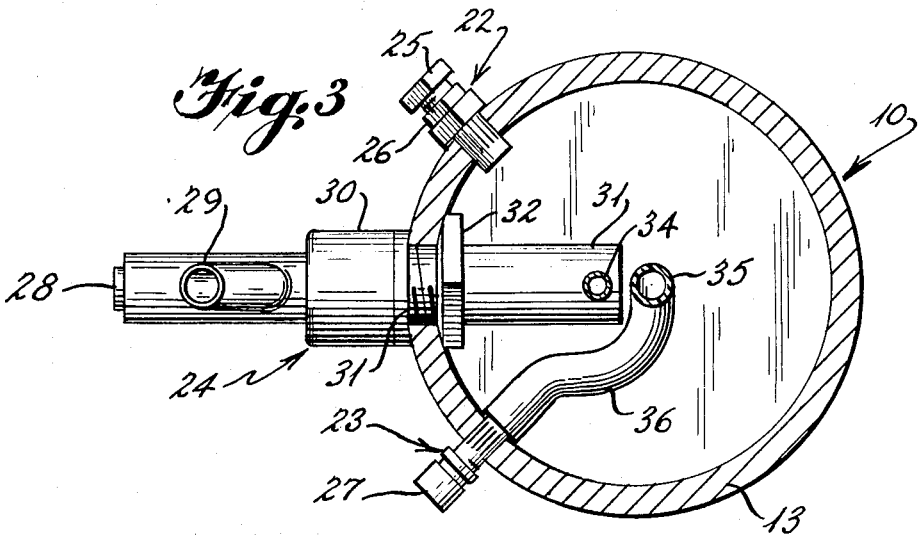
FIG. 3 is a cross sectional view taken along lines 3—3 of FIG. 1.

With respect to the dispensing enclosures of the present invention, such enclosures are designed to permanently retain the contents of an opened bottled of wine or other beverage or comestible product until the contents have been totally dispensed therefrom. In FIGS. 1–3, a first embodiment of enclosure 10 is disclosed for housing an opened bottle 12 of wine W. The enclosure 10 is shown as being generally cylindrical in configuration and includes an upper removable lid or cap 13, side walls 14 and removable lower closure member 15. The side walls 14 are preferrably made of a clear or transparent plastic or glass material so that the contents of the bottle 12 may be visual at all times. Both the upper and lower ends 16 and 17 of the side walls 14 are threaded so as to permit the upper and lower closure members 13 and 15 to be selectively secured thereto by mating threaded surfaces 18 and 19, respectively. In addition, upper and lower ring gaskets 20 and 21 are provided to create air tight seals between the closures and the side walls of the container. The end caps or closure members may be constructed of a plastic or metallic material. The size of the enclosure may vary depending upon the size of bottle or other container 12 being housed therein. The enclosure must, however, be of sufficient size to completely enclose the product container.

The upper cap or closure member 13 of the enclosure has a gas outlet valve 22, gas inlet valve 23 and fluid outlet or dispensing valve 24 mounted therethrough. The outlet valve 22 is a conventional adjustable bleed valve and may be selectively adjusted to relieve pressure within the enclosure when the pressure therein exceeds a predetermined maximum such as approximately 15 p.s.i.g. The valve will remain opened as the pressure in the enclosure is raised to be 20 to 30 p.s.i.g. and will close when the pressure drops to below the predetermined maximum. The valve shown includes nuts 25 and 26 which are adjustabe to vary the compression of an inner valve spring to thereby create an exhaust port which will open when the pressure in the enclosure exceeds the preselected desired maximum which is preferrably in the range of 10 to 15 p.s.i.g.

The gas inlet valve 23 is also of conventional design and is similar to a valve on a tire. As shown, a cap 27 is threadingly engaged over the end of the valve in order to prevent dust or other foreign material from contaminating the valve structure or opening.

The fluid outlet valve 24 is also of conventional design. The valve 24 includes a dispensing button 28 which is operable to open an inner valve plug in order to create an open fluid channel between the interior of the enclosure 10 and the faucet 29. The base 30 of the dispensing valve is engaged to a threaded nipple 31 which is fixedly mounted through the side walls of the cap or closure 13 utilizing a locknut member 32 which is disposed inside of the cap. The nipple 31 extends inwardly of the enclosure 10 and is completely enclosed or sealed with the exception of an opening 33 (as shown in FIG. 4) through which a fluid dispensing tube 34 is fixedly disposed so as to be in open fluid communication with the nipple 31.

The dispensing tube 34 extends from its innermost or intake end 34' which is disposed adjacent the bottom of the bottle 12 to a discharge or upper end which is in fluid communication with the dispensing valve 24 via the nipple 31.

Also shown in FIG. 2 is a gas inlet tube 35 which is oriented in generally parallel relationship to the fluid outlet or dispensing tube 34. The gas inlet tube is mounted via a flexible tube 36 to one side of the gas inlet valve 23. The lower portion of the inlet tube includes a one way valve 38 which will permit gas to pass therethrough into the bottle 12 but will prevent the liquid within the bottle from entering the tube. For purposes of rigidity, the gas inlet tube may be secured to the fluid dispensing tube by a clip or similar locking device 39.

In use of the enclosures 10 of FIGS. 1–3 after an opened bottle of wine has been placed within the enclosure and the ends thereof sealed, an inert gas such as nitrogen is introduced under pressure through the gas inlet valve 23 into the enclosure. In this embodiment, the gas will enter the enclosure through gas inlet tube 35 which is disposed within the bottle 12. As the gas is supplied, it will bubble up through the wine and enter the area surrounding the bottle. As the bottle is opened within the enclosure, the inert gas will be applied equally within the bottle and the area surrounding the bottle thereby balancing the pressure both interiorly and exteriorly of the bottle. The air originally within the enclosure will be automatically bled from the container by operation of the outlet valve 22 as the pressure rises above the predetermined maximum for the valve as the nitrogen is being introduced into the enclosure. Therefore, if the outlet valve is adjusted to open at 15 p.s.i.g., the valve will begin to vent any air and excess nitrogen when the pressure within the enclosure reaches 15 p.s.i.g. The pressure of inert gas, however, is raised above approximately 20 p.s.i.g. and then allowed to be reduced by operation of the outlet valve 22. The pressure may be further reduced for storage and dispensing to pressures of between 5 to 10 p.s.i.g. The wine is dispensed by operation of the valve 24. The initial dispensing pressure, as for example approximately 10 p.s.i.g., will drop as the wine is dispensed. The pressure may drop to 1 p.s.i.g. or less, however, sufficient gas pressure is initially supplied to insure that the entire contents of the bottle will be completely dispensed.

Another feature of the present embodiment of the invention is that in addition to the enclosure 10 providing both a storage and dispensing function for such products as wine and the like, the enclosure also provides an environment in which opened bottles of wines and the like may be selectively aged.

Utilizing the gas inlet valve and tube arangement of the present embodiment, it is not only possible to introduce nitrogen under pressure within the enclosure in order to prevent any deterioration of the wine contained within the bottle 12, as has been discussed, but it is also possible to selectively introduce relatively pure oxygen into the container in order to promote rapid oxidation of a wine contained therein. It has been found that some wines when opened and tasted have not reached their peak. In this regard, utilizing the apparatus of the present invention, it is possible to introduce relatively pure oxygen to accelerate the oxidation process of the wine. By introducing the oxygen at pressures in excess of approximately 20 p.s.i.g., it is possible to speed the oxidation process into minutes or hours as opposed to days, weeks or even years. When utilizing the aging process utilizing the apparatus of this invention, the source of oxygen is connected to the gas inlet valve 23 and thereafter oxygen is introduced directly into the wine within the enclosure through the tube 35. As the oxygen is introduced directly into the wine and is allowed to bubble therethrough, the oxidation process is believed to be accelerated. Once the oxygen has been introduced into the container and allowed to remain in contact with the wine over a predetermined period of time, the wine is selectively tasted by withdrawing the same through the dispensing valve 34. Once the wine has been determined to have reached its peak, the oxygen in the bottle is purged by closing off the source of oxygen supply through the valve 23, and thereafter introducing nitrogen under pressure through the gas inlet valve 23. The gas outlet or bleed valve 22 will be selectively opened when the nitrogen being introduced into the enclosure reaches the purging pressure or predetermined maximum venting pressure thereby allowing all the oxygen to be forced therefrom by the continuing incoming nitrogen. As with the prior examples, the nitrogen pressure is raised to a level of approximately 20 p.s.i.g. or more thereby preventing any further oxidation aging of the wine. Thereafter, the pressure is reduced and the wine ready for storage or dispensing as discussed above.

In the embodiment shown in FIG. 4, the enclosure is substantially identical to that shown in FIGS. 1–3 with the exception that the gas inlet tube and flexible connector or conduit which connects the inlet valve to the tube are not included. In this embodiment, incoming inert gas and/or oxygen is supplied to the enclosure exteriorly of the bottle directly through the gas inlet valve 23. This structure is regarded as being the basic structure of the invention as the testing, including those tests previously mentioned, indicate that the inert gas need not be bubbled through the wine in order to effectively prevent further aging of the wine. Also when the enclosure is used to age wine, the oxygen may introduced above the wine as opposed to being bubbled through it, although, it is believed that introducing the oxygen directly into the wine may accelerate the aging process.

Figure 5:
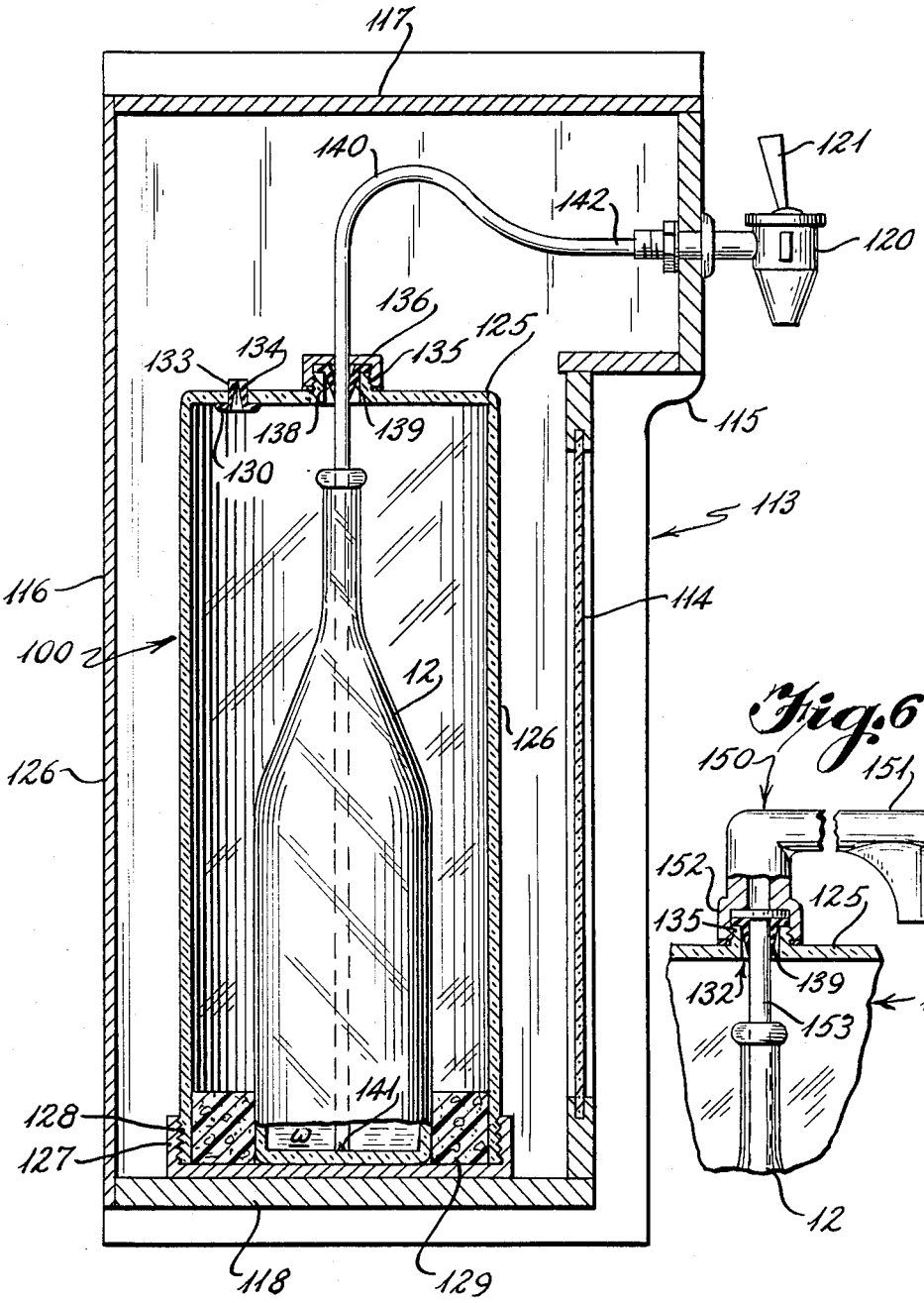
FIG. 5 is a cross sectional illustrational view showing another embodiment of the present invention as it is used to house an opened bottle of wine within a conventional refrigerated wine dispenser.
Figure 6:
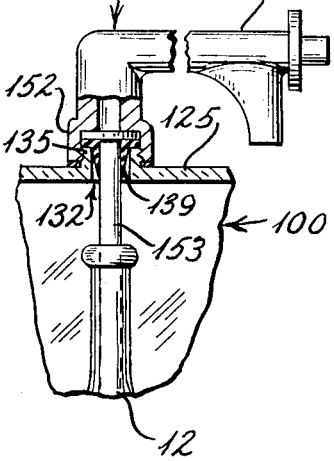
FIG. 6 is a partial cross sectional view showing the apparatus of FIG. 5 utilizing a separate dispensing valve as opposed to a conventional dispensing cabinet.

With particular reference to FIGS. 5 and 6 of the drawings, another embodiment of enclosure 100 is disclosed for housing an opened bottle 12 of wine W. The enclosure 100 is shown as being stored within a conventional refrigerated dispensing cabinet 113 which includes a front glass access panel 114, front and rear walls 115 and 116 upper and lower walls 117 and 118 and dispensing valve 120. The dispensing valve 120 is also of conventional design and is normally closed being operable by way of manipulation of the valve handle 121. The area 122 within the dispensing cabinet is refrigerated by a refrigeration unit (not shown).

The enclosure 100 is shown as being generally cylindrical in configuration and incudes an upper end wall 125, side walls 126 and removable cap or closure member 127. As with the prior embodiment, at least the side walls 126 are preferrably constructed of a clear or transparent plastic, plexiglass or glass material so that the contents of the bottle 12 may be visual at all times. The lower end 128 of the side walls 126 is threaded so as to permit the closure member to be selectively secured thereto. The closure member may be constructed of a plastic or metallic material. In order to stabilize the bottle or container 12 within the enclosure 10, a foam ring 129 may be fitted around the bottle so as to engage the inner side walls of the enclosure.

The upper end wall 125 of the enclosure includes a gas outlet valve 130 and combination gas inlet and fluid outlet valve 132. The outlet valve is of conventional design and is selectively opened to relieve pressure within the enclosure when the pressure therein exceeds a predetermined maximum or purging pressure such as previously discussed. The valve shown is a duckbill type valve having opposed resilient closure legs 133 and 134 which are separated to create an exhaust port or opening when the pressure in the enclosure exceeds the desired maximum and will maintain an exhaust opening until the pressure drops below that maximum.

The fluid outlet and gas inlet valve 132 is a dual purpose valve. As shown, the valve includes an outer threaded exterior nipple 135 which can be sealed by a cap 136 having a central opening 137 therein or by a cap which is totally closed. A duckbill type valve member 138 is disposed within the opening 139 created by the nipple and serves to close the opening against the pressure therein. The valve member 138, however, will open when gas is introduced into the enclosure and will also be opened and sealed against a dispensing tube 140 which is selectively inserted through the cap 136.

The dispensing tube 140 extends from its innermost or intake end 141 which is disposed adjacent the bottom of the bottle 12 to a discharge or outermost end 142 which is in fluid communication with the dispensing valve 120.

In use of the enclosures 100 of FIG. 5, after an opened bottle of wine has been placed within the enclosure and the cap 127 sealed, an inert gas such as nitrogen is introduced under pressure through the gas inlet and fluid outlet valve 132. As the bottle is opened within the enclosure, the inert gas will be applied equally within the bottle and the area surrounding the bottle. The air originally within the enclosure will be automatically bled from the container by operation of the outlet valve 130 as the pressure rises above the predetermined maximum for the valve as the nitrogen is being introduced into the enclosure. The pressure of inert gas is raised above approximately 20 p.s.i.g. and then lowered to approximately 15 p.s.i.g. again by operation of the outlet valve 130. The pressurized enclosure may now be stored or placed into service in a dispensing cabinet such as that shown at 113 or the pressure therein further reduced to a lower initial dispensing pressure of between 5 to 10 p.s.i.g. and then the enclosure stored for future use. Once the enclosure is in the cabinet, the fluid conduit or tube 140 is forced through the opening in cap 136 and the gas inlet and fluid outlet valve 132 and down into bottle 12. The valve member 139 will create a seal around the tube thereby preventing the escape of the nitrogen from the enclosure 100. The wine in the bottle is subsequently dispensed by operation of the valve and valve handle 120 and 121. The initial dispensing pressure will continue to drop as the wine is dispensed. The pressure may drop to substantially zero p.s.i.g., however, sufficient gas is initially available to provide complete dispensing of the contents of the bottle.

Instead of utilizing the enclosure 100 of FIG. 5 in a conventional wine dispensing cabinet, the wine may be directly dispensed from the enclosure by utilizing a valve and tube assembly 150 as shown in FIG. 6. In this embodiment, a conventional pressure reducing dispensing valve 151 is modified to include a threaded base portion 152 which is threadingly engaged with the nipple 135 so as to be aligned in fluid communication with the valve 132. A dispensing tube 153 is carried by the valve 151 and extends through valve 132 and into the bottle 12.

Figure 7:
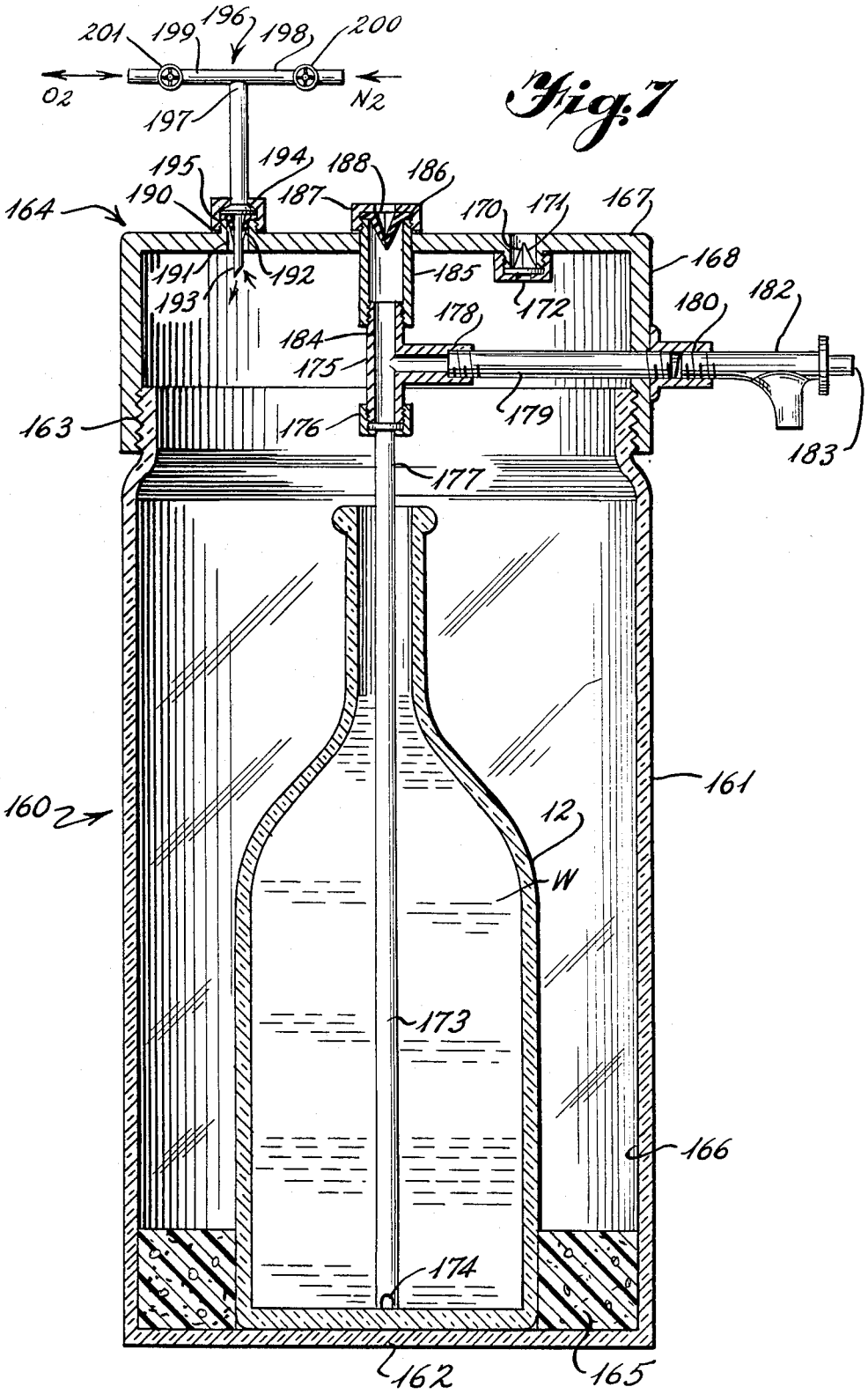
FIG. 7 is a cross sectional illustrational view showing another embodiment of beverage dispensing apparatus which houses an opened bottle of wine for selective dispensing in accordance with the teachings of the present invention.

Another embodiment of dispensing enclosure of the present invention is shown in FIG. 7. In this embodiment, the dispensing enclosure 160 is constructed to provide both a storage and dispensing function for such products as wines as well as to provide a container in which open bottles of wines and the like may be selectively aged. The enclosure includes a generally clear or transparent cylindrical body portion having side wall 161 and bottom wall 162. The upper portion of the side walls is threaded as shown at 163 in order to cooperatively receive a lid or cover member 164. The enclosure 160 houses a bottle 12 having wine W contained therein. In order to secure the bottle within the enclosure, a foam ring 165 is provided around the bottle 12 and extends outwardly engaging the inner side walls 166 of the enclosure. The lid or cover 164 includes an upper surface portion 167 and depending side wall portions 168 which are threadingly engaged with the threaded upper end portion of the body of the enclosure.

As with the structure of the first embodiment of the invention, a gas outlet or relief valve 170 is provided through the upper portion of the lid 164. The gas outlet 170 includes a pair of resilient valve flaps 171 which are normally in closed relationship with respect to one another thereby preventing the escape of gas within the enclosure through the opening 172 in the valve. When the pressure within the enclosure reaches or exceeds a predetermined maximum purging pressure such as 15 p.s.i.g., the flaps 171 will be forced open allowing pressure within the container to escape as the pressure within the enclosure is continuously increased as discussed above.

The bottle of wine housed within the enclosure may be dispensed utilizing either an integrally attached dispensing faucet or remote faucets such as found in conventional wine dispensing cabinets. To enable this dual dispensing feature, a wine dispensing tube 173 is shown as extending from its lowermost end portion 174 which is adjacent the bottom of bottle 12 upward to a T connection of fitting 175 disposed above the top of the bottle. A fitting 176 is utilized to connect the upper end portion 177 of the dispensing tube 173 with one end of the T coupling 175. A first outlet channel 178 of the T connection extends generally perpendicularly with the dispensing tube 173 and is threadingly connected to a discharge tube 179 which extends through the depending side wall portion 168 of the cover 164. The outer end of the discharge tube is threadingly connected at 180 to a conventional pressure reduction dispensing valve 182 which is operable using a pushbutton assembly 183.

A second outlet channel 184 is provided in the T connection 175 and extends generally in axial alignment with the fluid dispensing tube 173. The outlet channel 184 is threadingly connected to a tubular fitting 185 which extends upwardly through the upper surface 167 of the lid 164. A duckbill valve member 186 is disposed through the uppermost end portion of the tubular fitting 185 and thereby provides a seal for preventing the escape of gas or fluid therethrough while permitting the insertion of a remote tube therethrough which tube may receive fluid being channeled thereto from the fluid or wine dispensing tube 173. The valve member 186 is shown as being retained in position by a cap 187 having a central opening 188 therein which is used to selectively guide an exterior fluid discharge tube similar to that shown at 140 with respect to the embodiment of the invention shown in FIG. 5. In addition, the operation of the valve assembly 186 is similar to that discussed with respect to the operation of the valve assembly 132 shown in FIG. 5 so that a fluid outlet tube inserted therethrough and extending to a remote dispensing nozzle will be sealed to prevent the escape of fluid between the outlet tube and the valve 186.

As with the prior embodiments of FIGS. 1–4, the dispensing enclosure of the present embodiment also includes a gas inlet valve 190 which extends through an opening 191 in the upper portion 167 of the lid 164. The inlet valve 190 includes a centrally disposed duckbill valve 192 which is generally closed but which is opened upon the insertion of a gas inlet nozzle 193 which may be secured in place by a screw threaded cap portion 194 which engages a threaded nipple portion 195 which extends upwardly from the upper surface 167 of the cap 164. The gas inlet nozzle 193 is connected to a gas supply assembly 196 which includes a T connector 197 having one branch 198 connected to a source of inert gas such as nitrogen under pressure and a second conduit 199 attached to a source of oxygen under pressure. A pair of spaced valves 200 and 201 may be selectively used to close either of the branch conduits 198 or 199 respectively.

Utilizing the gas inlet valve arrangement of the present embodiment, nitrogen under pressure may be introduced within the enclosure in order to prevent any deterioration of the wine product contained within the bottle 12 as was discussed with respect to the embodiment of FIGS. 1–4. Likewise, relatively pure oxygen may be selectively introduced into the container in order to promote rapid oxidation of a wine product contained therein. Again, by introducing oxygen at pressures in excess of approximately 20 p.s.i.g., it is possible to speed the aging process. Once the oxygen has been introduced into the container and allowed to remain in contact with the wine over a predetermined period of time, the wine is selectively tasted to determine if the wine has reached its peak. Thereafter, the oxygen in the bottle is purged by closing off the valve 201, opening the valve 200 and introducing nitrogen under pressure through the gas inlet nozzle 193. The gas outlet valve 170 may be selectively opened as the nitrogen is being introduced into the enclosure thereby allowing all the oxygen to be forced therefrom by the incoming nitrogen. As with the prior examples, the nitrogen pressure is then brought to a level of approximately 20–30 p.s.i.g. or more thereby preventing any further oxidation or aging of the wine within the bottle. The pressure is thereafter selectively reduced for storage and dispensing.

I claim:

1. A beverage preserving and dispensing apparatus for dispensing the fluid contents from an opened container of the beverage comprising an enclosure means, said enclosure means having a body portion within which the opened container is housed, removable closure means for sealing said body portion of said enclosure means from the outside atmosphere, a dispensing tube means extending inwardly of said body portion and within the opened container, first dispensing valve means connected to said dispensing tube means for selectively dispensing the fluid contents of the opened container exteriorly of said enclosure means, an inlet gas valve means in said enclosure means for permitting the supply of an inert gas into said enclosure means, a pressure release valve mounted to said enclosure means for permitting the release of gases therein when pressures above a predetermined maximum are achieved within the enclosure means, a fluid discharge opening within said enclosure means, said dispensing tube means including a first tube section within said enclosure means extending into the opened container, a second tube section within said enclosure means communicating said first tube section with said first dispensing valve means, and a third tube section within said enclosure means communicating said first tube section with said fluid discharge opening, a second dispensing valve means and means for connecting said second dispensing valve means to said fluid discharge opening so as to be in open communication with said third tube section of said dispensing tube means, and said first dispensing valve means being mounted directly to said enclosure means and said second dispensing valve means being disposed remotely of said enclosure means.

2. A beverage preserving and dispensing apparatus for dispensing the fluid contents from an opened container of the beverage comprising an enclosure means, said enclosure means having a body portion within which the opened container is housed, removable closure means for sealing said body portion of said enclosure means from the outside atmosphere, a dispensing tube means extending inwardly of said body portion and within the opened container, first dispensing valve means connected to said dispensing tube means for selectively dispensing the fluid contents of the opened container exteriorly of said enclosure means, an inlet gas valve means in said enclosure means for permitting the supply of an inert gas into said enclosure means, gas supply means connected to said gas inlet valve means, said gas supply means including a first supply line connected to a source of inert gas under pressure, a second supply line connected to a source of oxygen gas under pressure and valve means for selecting and regulating the flow of either the oxygen gas or the inert gas through said gas inlet valve means and into said enclosure means, and a pressure release valve mounted to said enclosure means for permitting the release of gases therein when pressures above a predetermined maximum are achieved within the enclosure means.

* * * * *